United States Patent [19]

Delmege et al.

[11] Patent Number: 4,679,950

[45] Date of Patent: Jul. 14, 1987

[54] DRAWER SLIDE WITH INFINITE ADJUSTMENT LOCKING MECHANISM

[75] Inventors: Dale Delmege, Santa Fe Springs; Richard O. Rask, Whittier, both of Calif.

[73] Assignee: Standard Precision, Inc., Santa Fe Springs, Calif.

[21] Appl. No.: 909,555

[22] Filed: Sep. 22, 1986

[51] Int. Cl.[4] ..... A47B 88/10

[52] U.S. Cl. ..... 384/18; 312/333

[58] Field of Search ..... 384/18, 19, 21, 49, 384/35; 312/333

[56] References Cited

U.S. PATENT DOCUMENTS

| | | | |
|---|---|---|---|
| 2,728,626 | 12/1955 | Gussack | 312/333 |
| 2,739,027 | 3/1956 | Gussack | 312/333 |
| 3,367,732 | 2/1968 | Beye | 312/333 X |
| 3,700,301 | 10/1972 | Boeck | 312/333 |
| 4,610,487 | 9/1986 | Delmege et al. | 384/18 |

*Primary Examiner*—Stuart S. Levy
*Assistant Examiner*—Thomas R. Hannon
*Attorney, Agent, or Firm*—Edgar W. Averill, Jr.

[57] ABSTRACT

A drawer slide with an infinite adjustment locking mechanism. The slide may be locked at any position and operates by moving a ball bearing against a protrusion in a ball bearing raceway. Preferably, the slide has an extending handle which permits it to move freely and when the handle is released, the slide is locked in position.

16 Claims, 4 Drawing Figures

DRAWER SLIDE WITH INFINITE ADJUSTMENT LOCKING MECHANISM

BACKGROUND OF THE INVENTION

The field of the invention is drawer slides and the invention relates more particularly to drawer slides of the type which are lockable in a desired position.

With the increasing use of computers, there is an added need to provide a drawer slide which can be locked in an open position. For instance, if a computer keyboard is contained in the drawer of a desk, it is desirable to be able to open the desk drawer and lock it in position.

One such drawer slide is disclosed in applicants' pending application, Ser. No. 776,409, filed Sept. 16, 1985 now U.S. Pat. No. 4,610,487. This disclosed a locking system utilizing a rubber block which is deformable by the turning of a cam which functions to hold the slide in a desired position. For some applications, the position of the handle on the outer slide member, or cabinet member, is inconvenient and the location of a handle on the inner slide member, or drawer member, is more useful for some applications.

SUMMARY OF THE INVENTION

It is an object of the present invention to provide a drawer slide locking mechanism which permits the locking of the slide in any position and may be operated from a handle extending from the inner slide member.

The present invention is for an improved drawer slide with an infinite adjustment locking mechanism for securing the slide in any position. The slide to be locked is of the type having an outer slide member having an inner end and an outer end and a pair of inwardly facing ball bearing supporting grooves. An inner slide member is positioned within the outer slide member and has a pair of outwardly facing ball bearing supporting grooves. A plurality of ball bearings is held between the grooves on the outer slide member and the grooves on the inner slide member and they are positioned by a ball retainer. The improvement comprises a protrusion positioned on the outer surface of at least one of the pair of outwardly facing ball bearing supporting grooves. At least one locking ball retainer is held by the inner slide member, and the locking ball retainer includes at least one locking ball bearing positioned adjacent the protrusion. Means are provided for moving the locking ball bearing into, and out of contact, with the protrusion. When in contact with the protrusion, the slide, when moved toward the protrusion, causes the locking ball bearing to bind against the protrusion and secure the slide in position. Preferably, a pair of protrusions, each protrusion having a locking ball bearing on each side thereof, is provided which securely is capable of locking the slide in any position. Preferably, the locking ball retainers are biased together and moved apart by a cam member operable by a handle affixed to the inner slide member.

DESCRIPTION OF THE PREFERRED EMBODIMENTS

Figures 1, 4:
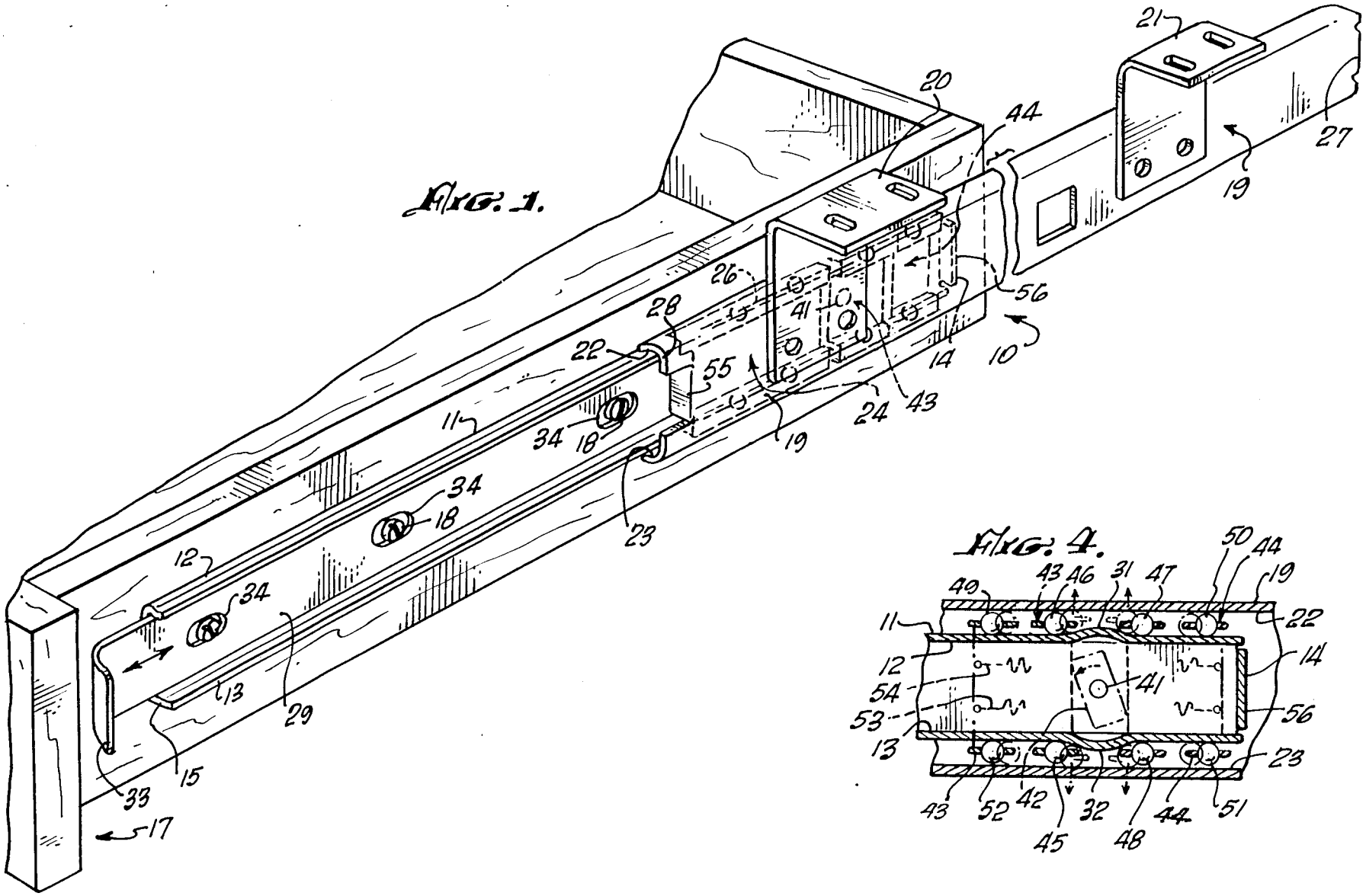
FIG. 1 is a perspective view of the drawer slide in an extended position.
FIG. 4 is a schematic view illustrating the operation of the locking mechanism of the slide of FIG. 1.

The drawer slide of the present invention is shown in perspective view in FIG. 1 and indicated generally by reference character 10. Slide 10 has an inner member 11 which has a pair of outwardly-facing ball bearing supporting grooves 12 and 13. Inner member 11 has an inner end 14 and an outer end 15. Inner member 11 is shown attached to the side 16 of a drawer 17 by a plurality of screws 18.

An outer slide member 19 is affixable to the cabinet into which the drawer is mounted by a pair of brackets 20 and 21. The horizontal portion of brackets 20 and 21 may be facing either inwardly or outwardly, depending upon the cabinet in which the drawer is mounted. Outer slide member 19 has a pair of inwardly-facing ball bearing grooves 22 and 23. A ball retainer 24 is shown in phantom view in FIG. 1 and is conventional in that it moves inwardly and outwardly at one-half of the distance of the inner member 11. A pair of locking ball retainers 43 and 44 is also shown in phantom view and will be described in detail below. Outer slide member 19 has an inner end 27 and an outer end 28.

Figures 2, 3:
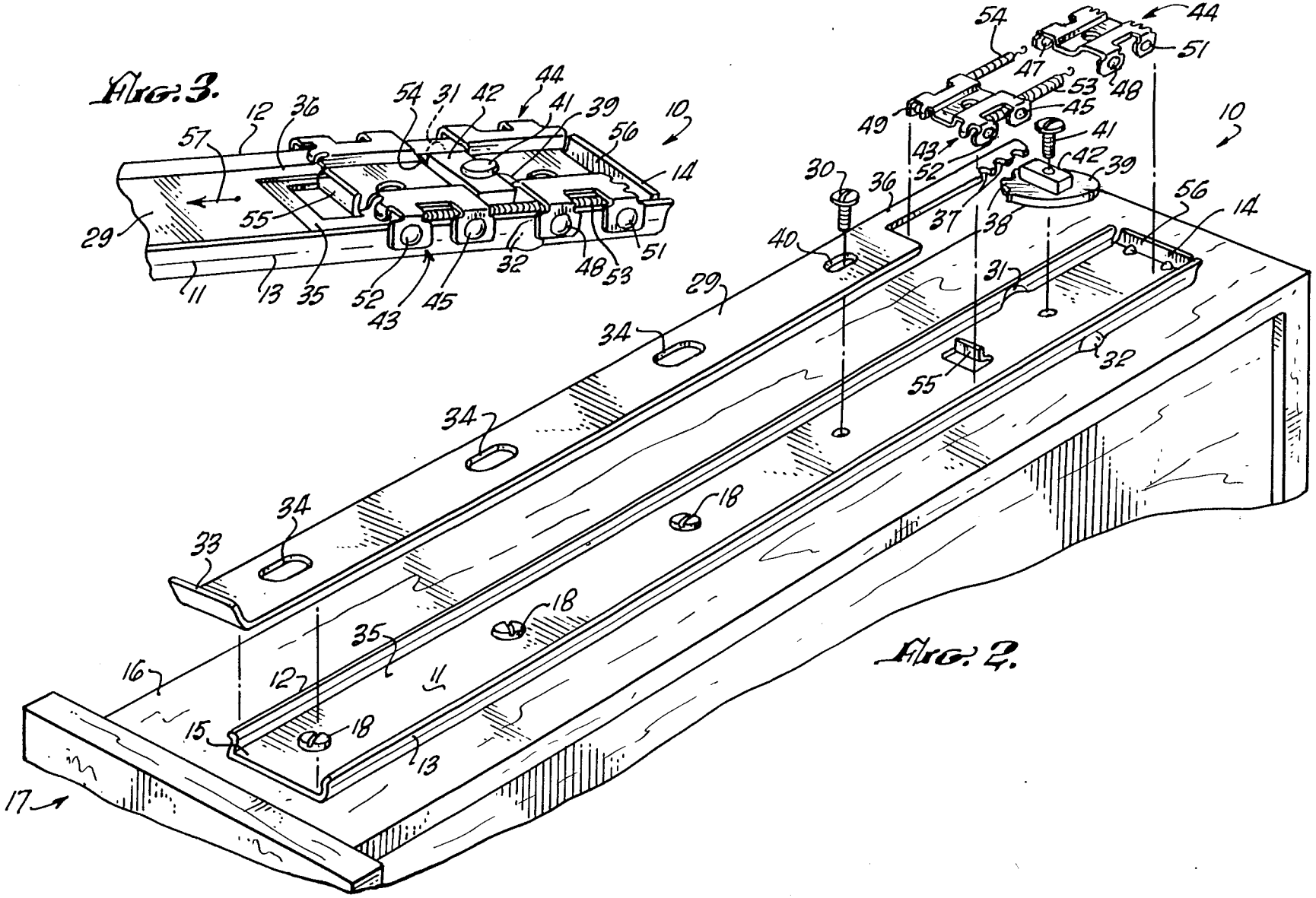
FIG. 2 is an exploded, perspective view of the inner slide member, the lock release member and the locking mechanism.
FIG. 3 is a perspective view of the inner end of the inner slide member including the locking mechanism.

A lock release lever 29 is held by a rivet 30 shown in FIG. 2 and operates the locking mechanism of drawer slide 10. The details of the locking mechanism are shown best in FIG. 2 where inner slide member 11 can be seen to have a pair of protrusions 31 and 32 which consist of bumps which are flared outwardly in outwardly-facing grooves 12 and 13.

It can be seen that lock release lever 29 has an operating handle 33 which permits the user to move lever 29 outwardly with respect to inner slide member 11. Slots 34 permit lock release lever 29 to be placed adjacent the web 35 of inner slide member 11. Rivet 30 is secured to web 35 and holds lock release lever 29 in place. A slot 40 is elongated to permit the slight in and out movement required by lock release lever 29.

Lock release lever 29 has a finger 36 which has gear teeth 37 which mesh with teeth 38 on cam member 39. Cam member 39 is rotatably held to web 35 by rivet 41. Cam member 39 has a rectangular cam 42 which serves to move the locking ball retainers apart when handle 33 is pulled outwardly with respect to inner member 11.

Two locking ball retainers 43 and 44, each hold a pair of locking ball bearings indicated by reference characters 45 through 48. These ball bearings are wedged against protrusions 31 and 32 as pointed out in more detail below. Ball bearings 49 through 52 are free turning and are used only to guide and support the locking ball retainers 43 and 44. A pair of springs 53 and 54 urge the locking ball retainers toward one another and, in turn, urge locking ball bearings 45 through 48 against protrusions 31 and 32. Ball retainer 24 shown in phantom view in FIG. 1 is conventional and provides the basic roller movement of the slide.

The locking ball retainers and cam are shown in assembled configuration in perspective view in FIG. 3 where it can be seen that tab 55 serves to limit the outward movement of locking ball retainer 43, and end tab 56 serves the same function for locking ball retainer 44. As lock release lever 29 is moved outwardly in the direction of arrow 57, rectangular cam 42 is turned and forces ball retainers 43 and 44 apart. This moves the locking ball bearings away from protrusions 31 and 32 and permits the free movement of the inner slide member with respect to the outer slide member. However, when handle 33 is released, springs 53 and 54 pull the locking ball retainers and the locking ball bearings against protrusions 31 and 32 and wedge them between the protrusion and the inwardly facing grooves 22 and 23 of the outer slide member 19. This action is depicted in schematic view in FIG. 4. It can be seen that the outward movement of inner slide member 11 will cause locking ball bearings 45 and 46 to wedge between protrusions 31 and 32 and the inwardly-facing grooves 23 and 22. Conversely, the inward movement of inner member 11 will cause locking ball bearings 47 and 48 to wedge against protrusion 32 and 31 and inwardly-facing grooves 22 and 23.

The result is a surprisingly secure holding of the slide at any desired position. The holding of the slide is without any movement and, thus, there is no rattling of the type occurring when a latch is held by a slot.

Although the above-described construction having two protrusions and four locking ball retainers is preferred, it is also contemplated that only one protrusion be used. Furthermore, for some applications, it might be appropriate only to prevent inward movement of the slide and, thus, only locking ball bearings 47 and 48 would be necessary. While the springs are shown as holding the locking ball retainers together, the spring could alternatively be placed on the lock release lever and perform the same function. Furthermore, while a cam action is shown to move the locking ball retainers apart, other means for bringing this about are also possible. It is, of course, preferable that the locking mechanism be placed near the inner end of the inner member to permit the maximum extension of the slide. It would, however, operate if placed further inwardly on the slide, but the outward movement of the slide would be limited. Furthermore, the converse operation would be possible where the protrusion is an indentation on inwardly-facing grooves 22 and 23 and the locking ball retainers be held by the outer slide member 19 near its outer end. It is preferable, however, that the member which is attached to the drawer contain the locking mechanism since it is most easily operated near the front of drawer 17.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved drawer slide with an infinite adjustment locking mechanism for securing the slide in any fraction of its extension, said slide being of the type having an outer slide member having an inner end and an outer end and a pair of inwardly-facing ball bearing supporting grooves, an inner slide member positioned within said outer slide member, said inner slide member having a pair of outwardly-facing ball-bearing supporting grooves, a plurality of ball bearings held between said pair of grooves on said outer slide member and said pair of grooves on said inner slide member, said ball bearings being positioned by a movable ball retainer, wherein the improvement comprises:

a protrusion positioned on the outer surface of at least one of said pair of outwardly facing ball bearing supporting grooves or one of said pair of inwardly facing ball bearing supporting grooves; and at least one locking ball retainer held by one of said inner slide member or said outer slide member, said locking ball retainer including at least one locking ball bearing positioned adjacent said protrusion and said locking ball retainer further including means for moving said at lest one locking ball bearing into and out of contact with said protrusion, whereby when said at least one locking ball bearing is out of contact with said protrusion, said slide moves freely, but when said at least one locking ball bearing is in contact with said protrusion, the movement of the outer slide member with respect to said inner slide member in the direction of said at least one locking ball bearing causes said at least one locking ball bearing to bind against said protrusion and to inhibit movement of the outer inner slide member in that direction.

2. The improved drawer slide of claim 1 wherein said protrusion is positioned near the inner end of said inner slide member.

3. The improved drawer slide of claim 1 wherein there is a protrusion on both of said outwardly facing ball bearing supporting grooves.

4. The improved drawer slide of claim 1 wherein there is a pair of locking ball retainers, each supporting at least one locking ball bearing, one locking ball bearing positioned on one side of said protrusion and the other positioned on the other side of said protrusion and each of said locking ball retainers including means for moving the locking ball bearings into and out of contact with said protrusion whereby when both of said locking ball bearings are in contact with said protrusion, movement of the inner slide with respect to the outer slide is inhibited in both directions.

5. The improved drawer slide of claim 4 wherein there is a protrusion on both of said outwardly-facing ball bearing supporting grooves.

6. The improved drawer slide of claim 5 wherein each of said locking ball retainers includes at least one additional ball bearing held on the side of said locking ball bearing which is away from said protrusion thereby supporting said ball locking ball retainer between said inner slide member and said outer slide member.

7. The improved drawer slide of claim 6 wherein said pair of locking ball retainers are urged toward each other by biasing means.

8. The improved drawer slide of claim 7 wherein said locking ball retainers are moved away from each other by cam means held between said locking ball retainers.

9. The improved drawer slide of claim 8 wherein said cam means are moved by a locking lever held by said inner slide member, said locking lever extending past the outer end of said inner slide member.

10. An improved drawer slide with an infinite adjustment locking mechanism for securing the slide in any fraction of its extension, said slide being of the type having an outer slide member having an inner end and an outer end and a pair of inwardly-facing ball bearing supporting grooves, an inner slide member having an outer end and an inner end and positioned within said outer slide member, said inner slide member having a pair of outwardly-facing ball bearing supporting grooves, a plurality of ball bearings held between said pair of grooves on said outer slide member and said pair of grooves on said inner slide member, said ball bearings being positioned by at least one movable ball retainer wherein the improvement comprises:

a protrusion positioned on the outer surface of both of said pair of outwardly-facing ball bearing supporting grooves near the inner end thereof; and a pair of locking ball retainers held by said inner slide member, said locking ball retainers including a pair of locking ball bearings positioned adjacent each side of said protrusions and said locking ball retainers further including means for moving said locking ball bearings into and out of contact with said protrusions, whereby when said locking ball bearings are out of contact with said protrusions, said slide moves freely, but when said locking ball bearings are in contact with said protrusions, the outer slide member is locked with respect to the inner slide member.

11. The improved drawer slide of claim 10 wherein each of said locking ball retainers includes at least one pair of additional ball bearings.

12. The improved drawer slide of claim 10 wherein said locking ball retainers are urged together by biasing means and urged outwardly by cam means.

13. The improved drawer slide of claim 12 wherein said biasing means comprises a pair of helical springs affixed near the upper and lower ends of said locking ball retainers.

14. The improved drawer slide of claim 12 wherein said locking ball retainers are moved away from each other by cam means held between said locking ball retainers.

15. The improved drawer slide of claim 14 wherein said cam means are moved by a locking lever held by said inner slide member, said locking lever extending past the outer end of said inner slide member.

16. The improved drawer slide of claim 10 wherein said protrusions are formed by deforming the inner slide member in the ball bearing supporting grooves.

* * * * *